US007098859B2

(12) United States Patent
Shimawaki et al.

(10) Patent No.: US 7,098,859 B2
(45) Date of Patent: Aug. 29, 2006

(54) ANTENNA UNIT

(75) Inventors: Yutaka Shimawaki, Tokyo (JP); Norio Takeuchi, Tokyo (JP); Izuru Naitou, Tokyo (JP); Hidenori Yoshizawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/541,034

(22) PCT Filed: Oct. 30, 2003

(86) PCT No.: PCT/JP03/13913

§ 371 (c)(1),
(2), (4) Date: Jun. 28, 2005

(87) PCT Pub. No.: WO2005/043677

PCT Pub. Date: May 12, 2005

(65) Prior Publication Data

US 2006/0097940 A1 May 11, 2006

(51) Int. Cl.
*H01Q 13/00* (2006.01)

(52) U.S. Cl. ..... 343/781 CA; 343/705; 343/756

(58) Field of Classification Search ..... 343/705, 343/756, 781 CA, 781 P, 786
See application file for complete search history.

(56) References Cited

U.S. PATENT DOCUMENTS 4,498,061 A * 2/1985 Morz et al. ..... 333/21 A
4,972,199 A * 11/1990 Raghavan et al. ..... 343/756
2003/0027586 A1* 2/2003 Johnson et al. ..... 455/517

FOREIGN PATENT DOCUMENTS

| | | |
|---|---|---|
| JP | 62-30406 | 2/1987 |
| JP | 02-274004 | 11/1990 |
| JP | 3-104326 | 5/1991 |
| JP | 11-17469 | 1/1999 |
| JP | 2002-141849 | 5/2002 |
| JP | 2001-196834 | 7/2002 |
| JP | 2003-198489 | 7/2003 |

* cited by examiner

*Primary Examiner*—Shih-Chao Chen
(74) *Attorney, Agent, or Firm*—Oblon, Spivak, McClelland, Maier & Neustadt, P.C.

(57) ABSTRACT

In a variable power divider including a first 90° phase combiner (30), a second 90° phase combiner (40), and a phase-amplitude adjustment block (50), the phase-amplitude adjustment block (50) includes, correspondingly to two-channel polarized signals, variable phase shifters (51, 52) for adjusting their phase amounts and variable attenuators (55, 56) for adjusting amplitudes (attenuation amounts), and the phase amounts and the amplitudes of the two-channel polarized signals can be adjusted by an antenna control unit (60). Further, there are included a phase shifter (53) and an attenuator (57) provided on two-channel signal lines between an orthomode transducer (20) and a first 90° phase combiner (30) and for equalizing the amplitudes and phases of the two-channel polarized signals. By this, an antenna apparatus can be inexpensively provided which uses a reflector antenna (10) to perform transmission/reception of a signal to/from a satellite at high accuracy, and is miniaturized to be suitable for mounting on an aircraft or the like.

7 Claims, 8 Drawing Sheets

ANTENNA UNIT

This application is a 371 of PCT/JP03113913 filed Oct. 30, 2003.

TECHNICAL FIELD

The present invention relates to an antenna apparatus for transmitting/receiving a modulating signal of a radio frequency to/from a satellite, and particularly to a structure of an antenna apparatus which uses a reflector antenna and is miniaturized to be suitable for mounting on a moving body such as an aircraft.

BACKGROUND ART

FIG. 8 is a view showing a structure of a conventional antenna apparatus using a reflector antenna. In the drawing, reference numeral 10 denotes a reflector antenna part, and the reflector antenna part 10 includes a spherical main reflector 1, a secondary reflector 2, and a horn antenna 3.

Reference numeral 100 denotes a substantially cylindrical 180° polarizer, and the 180° polarizer 100 is rotatably supported by a rotary joint 110. The 180° polarizer 100 is rotated to coincide with a polarization coming from a satellite (not shown) or a polarization transmitted to the satellite, the plane of polarization is rotated, and transmission-reception is performed.

Incidentally, reference numeral 20 denotes an orthomode transducer (OMT: ORTHO MODE TRANSDUCER), and the orthomode transducer 20 divides a linear polarization signal, which is received by the reflector antenna part 10 and is transmitted through the 180° polarizer 100, into orthogonally polarizations to extract a Vertical polarization signal and an Horizontal polarization signal, or combines a V polarized and an Horizontal polarization signals orthogonal to each other and inputted from a Vertical polarization port and an Horizontal polarization port to convert them into a linear polarization signal.

The conventional antenna apparatus shown in FIG. 8 uses the 180° polarizer 100 constructed of a waveguide, there is a problem that the size of the apparatus becomes large, and is not suitable for mounting on an aircraft or the like in which an installation space is limited.

Besides, for example, JP-A-2002-141849 discloses a moving body satellite communication apparatus including an active phased array antenna which transmits a radio frequency signal outputted from a modulator-demodulator to a satellite, and receives a radio frequency signal transmitted from the satellite to output to the modulator-demodulator, a power detector for detecting the power of a reverse polarization contained in the radio frequency signal received by the active phased array antenna, and control means for controlling the plane of polarization of the active phased array antenna on the basis of the power detected by the power detector.

With respect to the transmission side active phased array antenna (transmission APAA), there are indicated a first splitter for dividing a modulating signal, which is frequency-converted by a transmission frequency converter, by the number of element antennas, a second splitter for dividing a modulating signal, which is terminated by a termination, by the number of the element antennas, and transmission APAA modules the number of which is sufficient to satisfy the antenna performance, and which receive the two-channel modulating signals of the modulating signal divided by the first splitter and the modulating signal divided by the second splitter to perform a transmission processing.

Besides, it is disclosed that each of the transmission APAA modules includes a first 90° phase combiner (90° HYB, also simply called a hybrid) for phase combining the two-channel modulating signals divided by the first splitter and the second splitter, a first and a second variable phase shifters respectively for phase shifting the two-channel modulating signals outputted from the first 90° phase combiner, first and second power amplifiers respectively for amplifying the outputs of the first and the second variable phase shifters, and a second 90° phase combiner for phase combining the output signals of the first and the second power amplifiers.

An apparatus in which the variable phase shifters as stated above and the two 90° phase combiners (hybrids) are used, and the power amounts of two inputted polarized signals are distributed at an arbitrary ratio and are outputted by changing the phase amounts of the variable phase shifters, is generally called a variable power divider.

Incidentally, a reception side active phased array antenna (reception APAA) has a similar structure to the transmission side active phased array antenna (transmission APAA) although the flow of signals to be processed is opposite.

Besides, JP-A-2-274004 discloses an array antenna including plural element antennas arranged on a curved surface and for transmitting or receiving a linearly polarized electric wave, a variable phase shifter connected to each of the element antennas, a variable power divider for distributing power amounts of two inputted polarized signals at an arbitrary ratio by changing the phase amount of the variable phase shifter, and a polarization control circuit for performing a control so that the direction of the linearly polarization of each of the elements is changed at intervals of $360°/2^n$ (n is a positive integer).

The foregoing antenna apparatus disclosed in JP-A-2002-141849 or JP-A-2-274004 can be miniaturized as compared with the foregoing antenna apparatus using the 180° polarizer constructed of the waveguide.

However, since it is necessary that according to the required antenna performance, the many element antennas (array antennas) are arranged and the variable power divider corresponding to each of the element antennas is provided, although a highly efficient antenna apparatus can be obtained, there is a problem that it becomes expensive.

The invention has been made to solve the problems as stated above, and has an object to provide an antenna apparatus which performs transmission/reception of a signal to/from a satellite by using a reflector antenna, is suitable for mounting on an aircraft or the like, is miniaturized and is inexpensive.

DISCLOSURE OF THE INVENTION

An antenna apparatus of the invention includes a reflector antenna part which receives a linear polarization signal from a satellite at a time of reception and transmits a linear polarization signal to the satellite at a time of transmission, an orthomode transducer which divides the linear polarization signal received by the reflector antenna part into two-channel polarized signals orthogonal to each other at the time of reception, and combines two-channel polarized signals orthogonal to each other to convert them into the linear polarization signal at the time of transmission, a variable power divider which includes a first 90°phase combiner, a second 90° phase combiner, and a phase-amplitude adjustment block provided with variable phase shifters and variable attenuators respectively corresponding to the two-channel polarized signals, adjusts, at the time of reception, phases and amplitudes of the two-channel polarization signals divided by the orthomode transducer and orthogonal to each other and outputs them as a V polarization and an H polarization, and adjusts, at the time of transmission, phases and amplitudes of the inputted two-channel polarized signals of a V polarization and an H polarization and inputs the polarized signals orthogonal to each other to the orthomode transducer, an antenna control unit which sets phase amounts of the variable phase shifters provided in the phase-amplitude adjustment block and corresponding to the two-channel polarized signals and attenuation amounts of the variable attenuators to desired values, and a phase shifter and an attenuator which are provided on at least one of two-channel signal lines between the orthomode transducer and the first 90° phase combiner, and equalizes amplitudes and phases of the two-channel polarized signals.

As a result, not only the phase amounts can be adjusted correspondingly to the two-channel polarized signals, but also the amplitudes (attenuation amounts) can be adjusted correspondingly to the two-channel polarized signals. Thus, even when a reflector antenna is used, the antenna apparatus can be inexpensively provided which can perform transmission/reception of a signal to/from a satellite at high accuracy, and is miniaturized to be suitable for mounting on an aircraft or the like.

Further, the control of the variable phase shifters and the variable attenuators in the phase-amplitude adjustment block can be performed without consideration of an error occurring in a section between the orthomode transducer and the first 90° phase combiner.

BEST MODE FOR CARRYING OUT THE INVENTION

Hereinafter, the best mode for carrying the invention will be described with reference to the drawings.

Incidentally, the same characters in the respective drawings denote the same or like parts.

Embodiment 1

Figure 1:
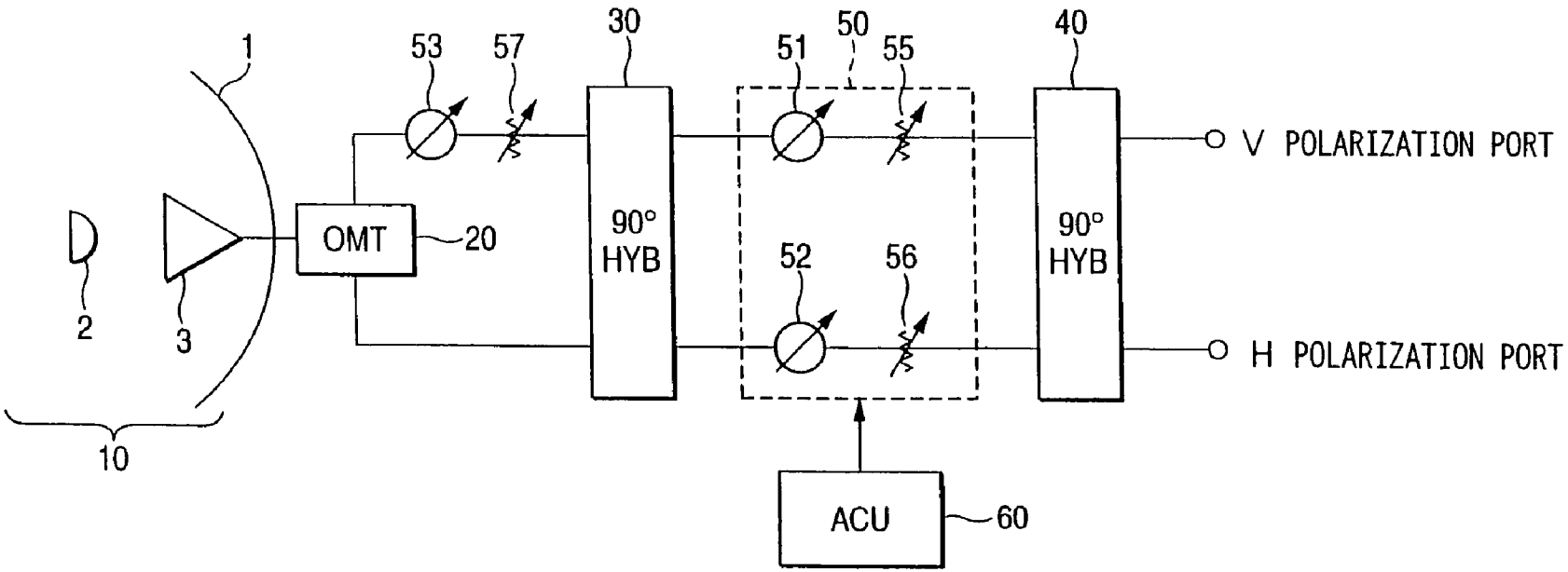
FIG. 1 is a view showing a structure of an antenna apparatus according to embodiment 1.

FIG. 1 is a view showing a structure of an antenna apparatus according to embodiment 1 of the invention.

In FIG. 1, reference numeral 10 denotes a reflector antenna part which receives a radio frequency signal (linear polarization signal) transmitted from a not-shown satellite or transmits a radio frequency signal (linear polarization signal) to the satellite, and the reflector antenna part 10 includes a spherical main reflector 1, a secondary reflector 2 and a horn antenna 3.

Reference numeral 20 denotes an orthomode transducer (OMT: ORTHO MODE TRANSDUCER) functioning as an interface between the antenna part 10 and a signal circuit, and the orthomode transducer 20 divides the radio frequency signal (linear polarization signal) received by the reflector antenna part 10 into two-channel orthogonal polarization, or combines two-channel orthogonal polarization to convert them into the linear polarization signal.

Reference numeral 30 denotes a first 90° phase combiner (90° HYB) disposed at the side of the orthomode transducer (OMT) 20; and 40, a second 90° phase combiner (90° HYB) disposed at the side of a Vertical polarization port and an Horizontal polarization port.

Incidentally, the 90° phase combiner has a function to divide a signal into two channels or combines signals while a phase of 90° is kept mutually.

Besides, reference numeral 50 denotes a phase-amplitude adjustment block for adjusting phases and amplitudes of the two-channel polarized signals, and in the phase-amplitude adjustment block 50, a first variable phase shifter 51 and a first variable attenuator 55 are disposed in series-in a first signal channel, and a second variable phase shifter 52 and a second variable attenuator 56 are disposed in series in a second signal channel.

Incidentally, the first 90° phase combiner 30, the second 90° phase combiner 40 and the phase-amplitude adjustment block 50 constitute a so-called variable power divider.

Besides, reference numeral 60 denotes an antenna control unit (ACU: ANTENNA CONTROL UNIT) for setting phase amounts of the first variable phase shifter 51 and the second variable phase shifter 52 in the phase-amplitude adjustment block 50, and amplitudes of the first variable attenuator 55 and the second variable attenuator 56 to desired values.

In the antenna apparatus according to this embodiment, an operation in a case where a radio frequency signal (linear polarization signal) is received from a not-shown satellite will be described.

The radio frequency signal (linear polarization signal) received by the reflector antenna part 10 is divided into two polarized signals orthogonal to each other by the orthomode transducer (OMT) 20.

The two divided polarized signals (two-channel signals) are phase combined by the first 90° phase combiner (90° HYB) 30 while a phase of 90° is kept, and are inputted to the phase-amplitude adjustment block 50.

Here, when the phase of the first variable phase shifter 51 is set to $+\phi/2$, and the phase of the second variable phase shifter 52 is set to $-\phi/2$, the plane of polarization can be adjusted to a polarization plane angle $\phi$.

Incidentally, in order to improve the accuracy of the antenna apparatus, it is necessary to correct an amplitude difference corresponding to a set phase difference of the respective variable phase shifters and an amplitude difference generated between the two channels, and in this embodiment, as shown in the first figure, the first variable attenuator 55 is provided in the first signal channel, and the second variable attenuator 56 is provided in the second signal channel.

Then, a structure is made such that the phase amount of the first variable phase shifter 51, the phase amount of the second variable phase shifter 52, the amplitude of the first variable attenuator 55, and the amplitude of the second variable attenuator 56 can be set to desired values by the antenna control unit (ACU) 60.

The signal of the first channel and the signal of the second channel in which the phases and amplitudes are adjusted in the phase-amplitude adjustment block 50 are phase combined by the second 90° phase combiner (90° HYB) 40, and are outputted as orthogonally polarizations (that is, a V polarization and an H polarization) having desired polarization angles from the Vertical polarization port and the Horizontal polarization port.

Next, an operation in a case where a radio frequency signal is transmitted to the satellite will be described.

A Vertical polarization signal and an Horizontal polarization signal respectively inputted to the Vertical polarization port and the Horizontal polarization port are phase combined by the second 90° phase combiner 40.

Two-channel signals outputted from the second 90° phase combiner 40 are adjusted by the antenna control unit (ACU) 60 to have desired phases and amplitudes, and are phase combined by the first 90° phase combiner 30.

The two-channel signals which are phase combined and are orthogonal to each other are converted into a linear polarization signal by the orthomode transducer (OMT) 20, and the converted linear polarization signal is transmitted from the reflector antenna part 10 to the not-shown satellite.

Incidentally, in the case where the distance between the orthomode transducer 20 and the first 90° phase combiner 30 is long, it becomes difficult to match the quantities of electricity and losses of the two-channel cables (signal lines).

When an amplitude difference and a phase difference occur in the polarized signals between the two channels, a polarization plane setting error occurs.

Thus, in this embodiment, a phase shifter 53 and an attenuator 57 are provided on one of the two-channel signal lines between the orthomode transducer 20 and the first 90° phase combiner 30, and the amplitudes and phases of the polarized signals of both channels are made equivalent to each other.

The amplitudes and phases of the polarized signals of both the channels are made equivalent, so that the control of the variable phase shifters and the variable attenuators in the phase-amplitude adjustment block 50 by the antenna control unit 60 can be performed without consideration of an error occurring in a section between the orthomode transducer 20 and the first 90° phase combiner 30.

Incidentally, although FIG. 1 shows the case where the phase shifter and the attenuator are provided on one of the two-channel signal lines between the orthomode transducer 20 and the first 90° phase combiner 30, the phase shifters and the attenuators may be provided on both the two-channel signal lines.

As described above, the antenna apparatus according to embodiment 1 includes the reflector antenna part 10 which receives a linear polarization signal from the satellite at the time of reception and transmits a linear polarization signal to the satellite at the time of transmission, the orthomode transducer 20 which divides the linear polarization signal received by the reflector antenna part 10 into two-channel polarized signals orthogonal to each other at the time of reception, and combines two-channel polarized signals orthogonal to each other to convert them into the linear polarization signal at the time of transmission, the variable power divider which includes the first 90° phase combiner 30, the second 90° phase combiner 40, and the phase-amplitude adjustment block 50 provided with the variable phase shifters and the variable attenuators respectively corresponding to the two-channel polarized signals, adjusts, at the time of reception, the phases and amplitudes of the two-channel polarization signals divided by the orthomode transducer 20 and orthogonal to each other and outputs them as the V polarization and the H polarization, and adjusts, at the time of transmission, the phases and amplitudes of the inputted two-channel polarized signals of the V polarization and the H polarization and inputs the polarized signals orthogonal to each other to the orthomode transducer 20, the antenna control unit 60 which sets the phase amounts of the variable phase shifters provided in the phase-amplitude adjustment block 50 and corresponding to the two-channel polarized signals and the attenuation amounts of the variable attenuators to desired values, and the phase shifter 53 and the attenuator 57 which are provided on at least one of two-channel signal lines between the orthomode transducer 20 and the first 90° phase combiner 30, and equalizes the amplitudes and the phases of the two-channel polarized signals.

As stated above, in the antenna apparatus according to this embodiment, the phase-amplitude adjustment block 50 of the variable power divider is provided with not only the variable phase shifters corresponding to the two-channel polarized signals and for adjusting their phase amounts, but also the variable attenuators corresponding to the two-channel polarized signals and capable of adjusting the amplitudes (attenuation amounts), and the phase amounts and amplitudes of the two-channel polarized signals can be adjusted by the antenna control unit 60, and further, the phase shifter 53 and the attenuator 57 to equalize the amplitudes and phases of the polarized signals of both the channels are provided on at least one of the two-channel signal liens between the orthomode transducer 20 and the first 90° phase combiner 30.

By this, even when the reflector antenna is used, the transmission/reception of a signal to/from the satellite can be performed at high accuracy, and the miniaturized antenna apparatus suitable for mounting on the aircraft or the like can be provided inexpensively, and further, the control of the variable phase shifters and the variable attenuators in the phase-amplitude adjustment block can be performed without consideration of the error occurring in the section between the orthomode transducer and the first 90° phase combiner.

Incidentally, in the case where the error occurring in the section between the orthomode transducer and the first 90° phase combiner is small, it is needless to say that the phase shifter 53 and the attenuator 57 provided on at least one of the two-channel signal lines between the orthomode transducer 20 and the first 90° phase combiner 30 can be omitted.

When the phase shifter 53 and the attenuator 57 are omitted, the antenna apparatus is simplified.

Embodiment 2

Figure 2:
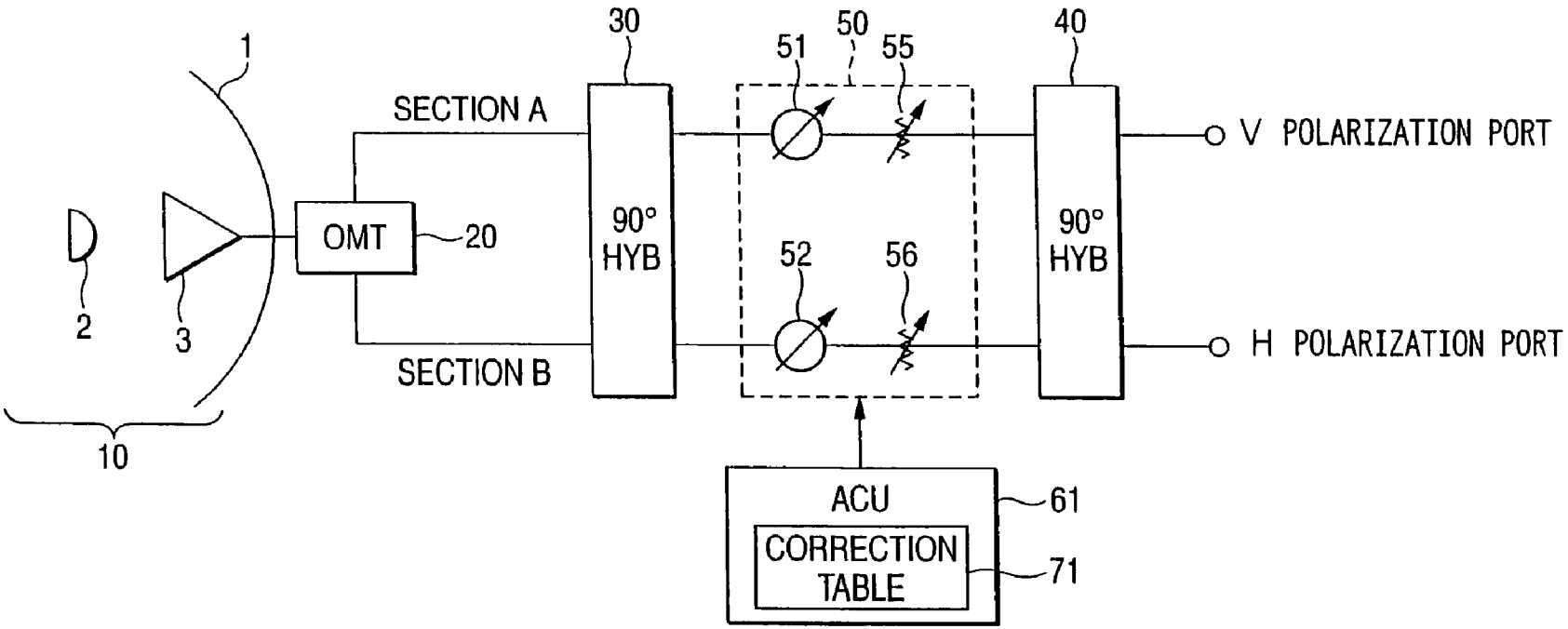
FIG. 2 is a view showing a structure of an antenna apparatus according to embodiment 2.

FIG. 2 is a view showing a structure of an antenna apparatus according to embodiment 2 of the invention.

As described above, an amplitude difference and a phase difference occurring in two-channel signal lines (indicated by a section A and a section B) between an orthomode transducer 20 and a first 90° phase combiner 30 become polarization plane setting errors.

Thus, in the antenna apparatus according to this embodiment, the amplitude difference and the phase difference occurring in the two-channel signal lines (the section A and the section B) between the orthomode transducer 20 and the first 90° phase combiner 30 are previously measured, and the measured values are stored as a correction table 71 in an antenna control unit 61.

When the control of variable phase shifters and variable attenuators in a phase-amplitude adjustment block 50 is performed by the antenna control unit 61, reference is made to the values stored in the correction table 71 and the control is performed.

By this, it becomes unnecessary to equalize the electric characteristics of cables (signal lines) used for the two-channel signal lines (the section A and the section B) between the orthomode transducer 20 and the first 90° phase combiner 30.

That is, it becomes unnecessary to provide the phase shifter and the attenuator on one of or both of the two-channel signal lines between the orthomode transducer 20 and the first 90° phase combiner 30 as in the embodiment 1.

Embodiment 3

Figure 3:
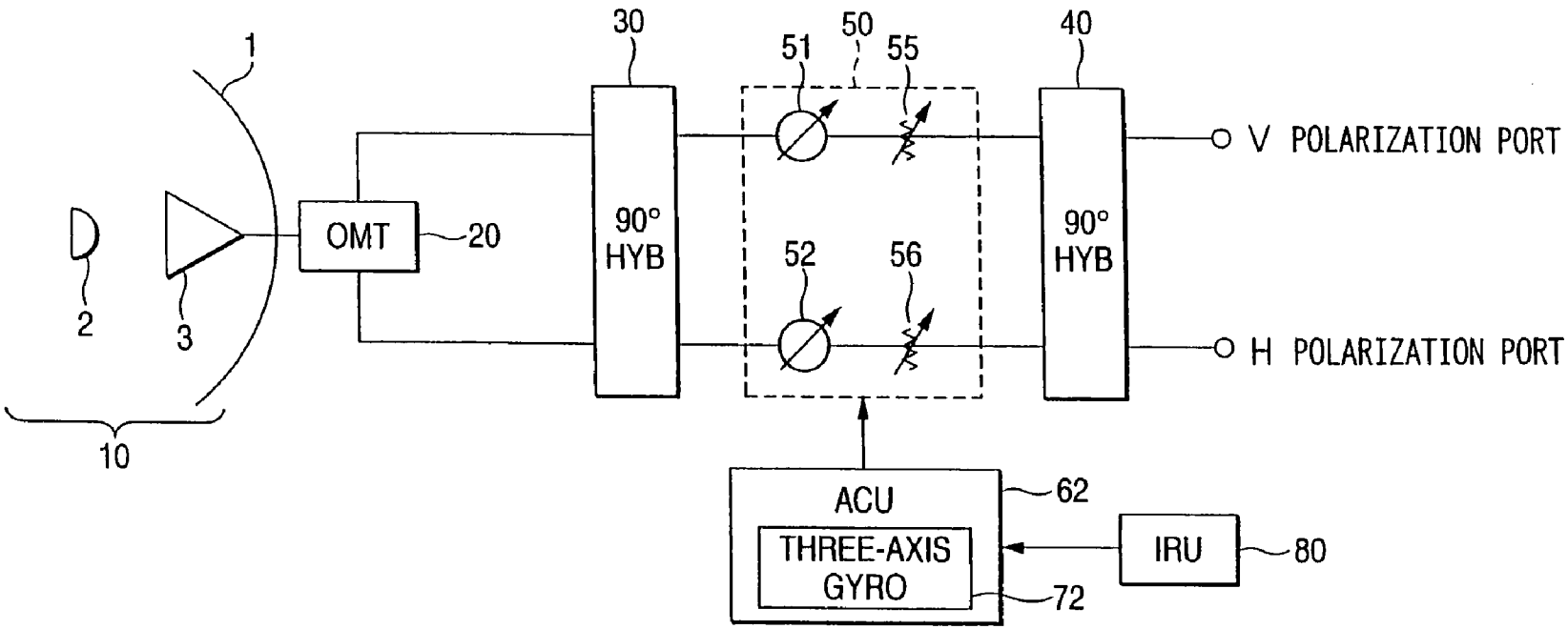
FIG. 3 is a view showing a structure of an antenna apparatus according to embodiment 3.

FIG. 3 is a view showing a structure of an antenna apparatus according to embodiment 3 of the invention.

In the case where an antenna apparatus is mounted on an aircraft, it is necessary that a polarization plane angle is calculated according to the position and tilt of the aircraft, and an antenna polarization plane angle of a reflector antenna part 10 is set.

An IRU (Inertia Reference Unit) 80 is mounted in an aircraft, and although the information of the position and tilt of the aircraft on which an antenna apparatus is mounted can be acquired from the IRU 80, a delay of several hundred msec occurs in data which can be acquired.

Thus, in the antenna apparatus according to this embodiment, a three-axis gyro 72 which can quickly acquire data of the position and tilt of the aircraft, although its accuracy is a little low, is mounted in an antenna control unit 62.

The antenna control unit 62 calculates a necessary polarization plane angle by using the data of the position and tilt of the aircraft acquired from the three-axis gyro 72 while the data from the IRU 80 is delayed, and performs the setting and control of variable phase shifters and variable attenuators in a phase-amplitude adjustment block 50.

When it becomes possible to acquire the data of the position and tilt of the aircraft from the IRU 80, the antenna control unit 62 calculates the necessary polarization plane angle on the basis of the data from the IRU 80, and performs the setting and control of the variable phase shifters and the variable attenuators in the phase-amplitude adjustment block 50.

As stated above, in the antenna apparatus according to this embodiment, since the three-axis gyro 72 is provided in the antenna control unit 62, even if the position and tilt of the aircraft carrying it are changed, the time delay is made small and the antenna polarization plane angle can be set.

Embodiment 4

Figure 4:
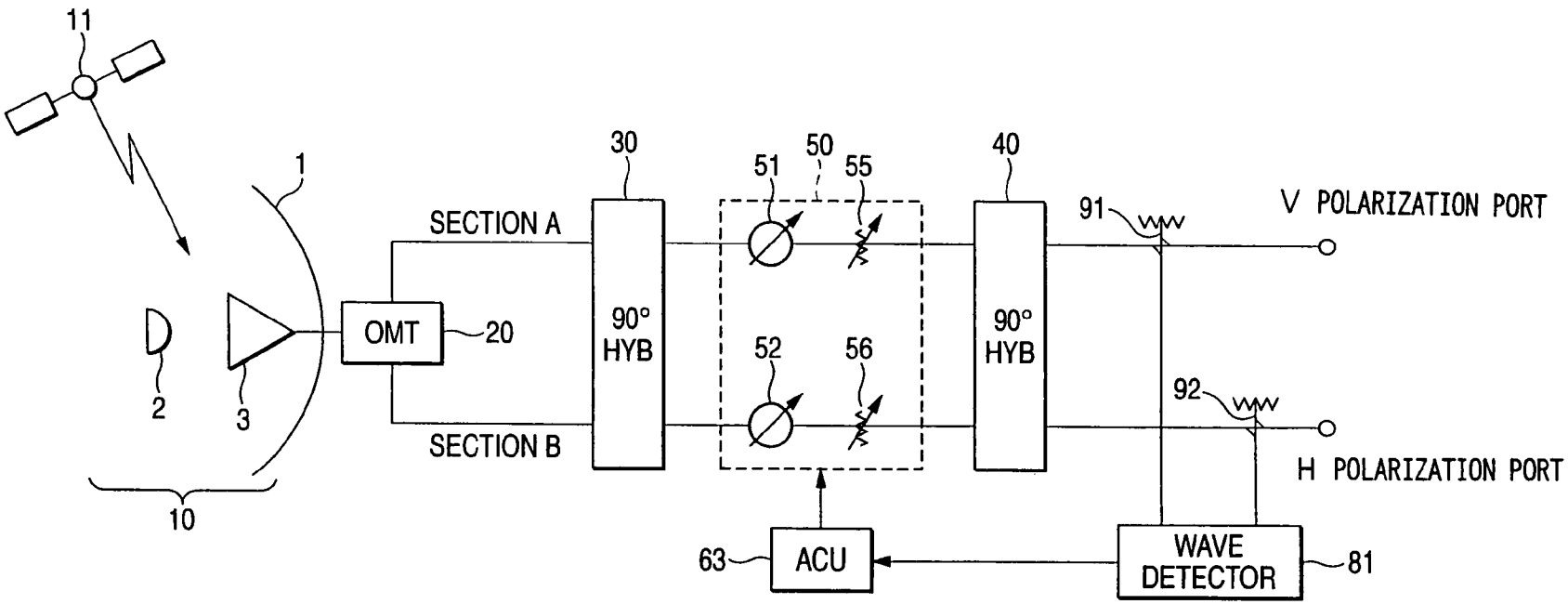
FIG. 4 is a view showing a structure of an antenna apparatus according to embodiment 4.

FIG. 4 is a view showing a structure of an antenna apparatus according to embodiment 4.

When an antenna part 10 receives a tilted linear polarization signal from a satellite 11, signals corresponding to the tilt of the linear polarization signal are outputted at a Vertical polarization port and an Horizontal polarization port.

Then, in the antenna apparatus according to this embodiment, couplers 91 and 92 are provided at the Vertical polarization port and the Horizontal polarization port respectively, and two-channel signals outputted at the Vertical polarization port and the Horizontal polarization port are detected by a wave detector 81.

On the basis of the detected result, an antenna control, unit 63 controls a first and a second variable phase shifters 51 and 52 of a phase-amplitude adjustment block 50 and a first and a second variable attenuators 55 and 56 so that one side of the two-channel signals outputted at the Vertical polarization port and the Horizontal polarization port becomes maximum (difference between both becomes maximum), and performs the setting and control of a polarization plane angle.

As stated above, in this embodiment, the signals processed by the phase-amplitude adjustment block 50 are put in a closed loop, so that the setting accuracy of the polarization plane angle can be improved.

Embodiment 5

Figure 5:
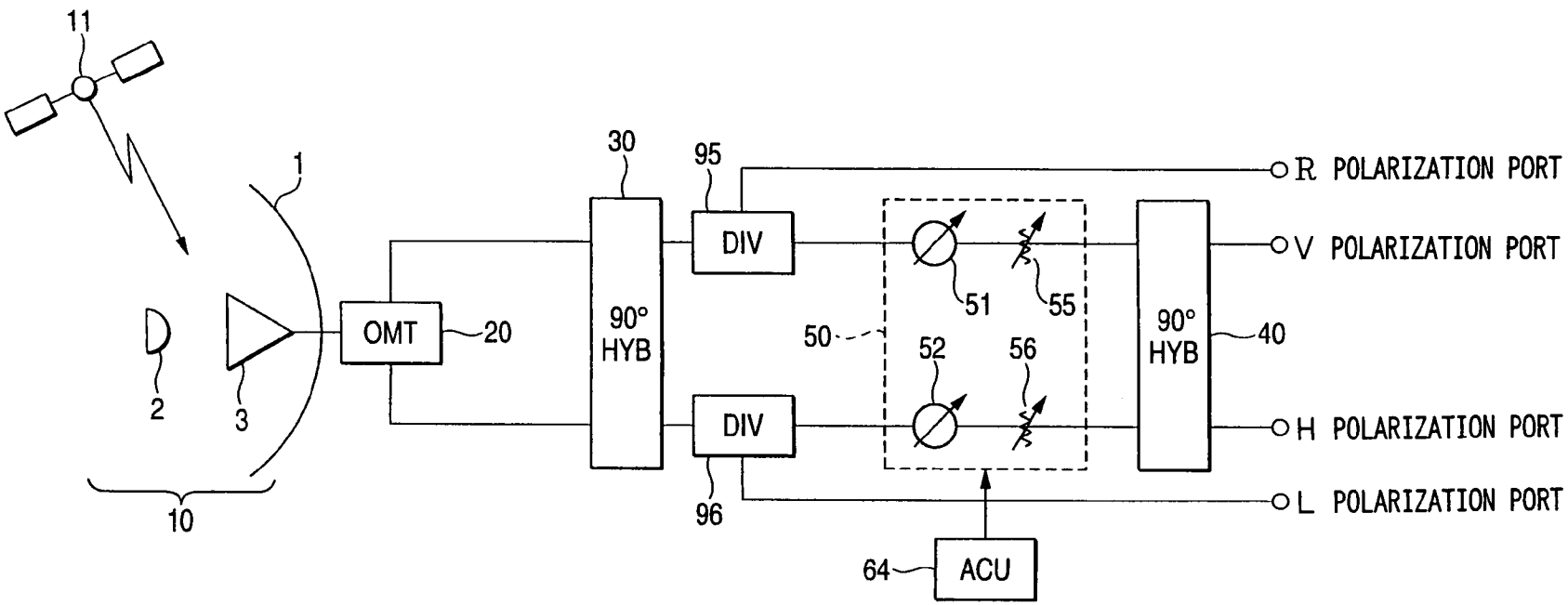
FIG. 5 is a view showing a structure of an antenna apparatus according to embodiment 5.

FIG. 5 is a view showing a structure of an antenna apparatus according to embodiment 5 of the invention.

In the antenna apparatus according to this embodiment, a DIV (Divider) is provided for each of two-channel signals outputted from a first 90° phase combiner 30, and the signal is further divided into two channels.

As shown in FIG. 5, similarly to the embodiment 1, a first variable phase shifter 51 and a first variable attenuator 55 are provided on one of two divided signal channels by a first DIV 95.

Besides, a second variable phase shifter 52 and a second variable attenuator 56 are provided on one of two divided signal channels by a second DIV 96.

Incidentally, reference numeral 50 denotes a phase-amplitude adjustment block including the first variable phase shifter 51, the first variable attenuator 55, the second variable phase shifter 52, and the second variable attenuator 56. Phases of the respective variable phase shifters of the phase-amplitude adjustment block 50*a* and attenuation amounts of the variable attenuators are set to desired values by an antenna control unit 64.

As shown in FIG. 5, two-channel signals which are divided by the first DIV 95 and the second DIV 96 and whose phases and amplitudes are adjusted in the phase-amplitude adjustment block 50 are respectively outputted as a Vertical polarization signal to a Vertical polarization port and as an Horizontal polarization signal to an Horizontal polarization port through a second 90° phase combiner 40.

Besides, two-channel signals which are divided by the first DIV 95 and the second DIV 96 and whose phases and amplitudes are not adjusted in the phase-amplitude adjustment block 50 are outputted as an R (right-handed) polarized signal to an R (right-handed) poralization port and as an L (left-handed) polarized signal to an L (left-handed) poralization port without passing through the second 90° phase combiner 40.

Since the antenna apparatus according to this embodiment is constructed as stated above, even if a polarization coming from a satellite 11 is any of a Vertical polarization signal, an Horizontal polarization signal, an R (right-handed) polarized signal, and an L (left-handed) polarized signal, the reception becomes possible.

Incidentally, in the above description, although the case of the reception has been described, even when an input signal is any of a Vertical polarization signal, an Horizontal polarization signal, an R (right-handed) polarized signal, and an L (left-handed) polarized signal, the transmission is possible.

Embodiment 6

Figure 6:
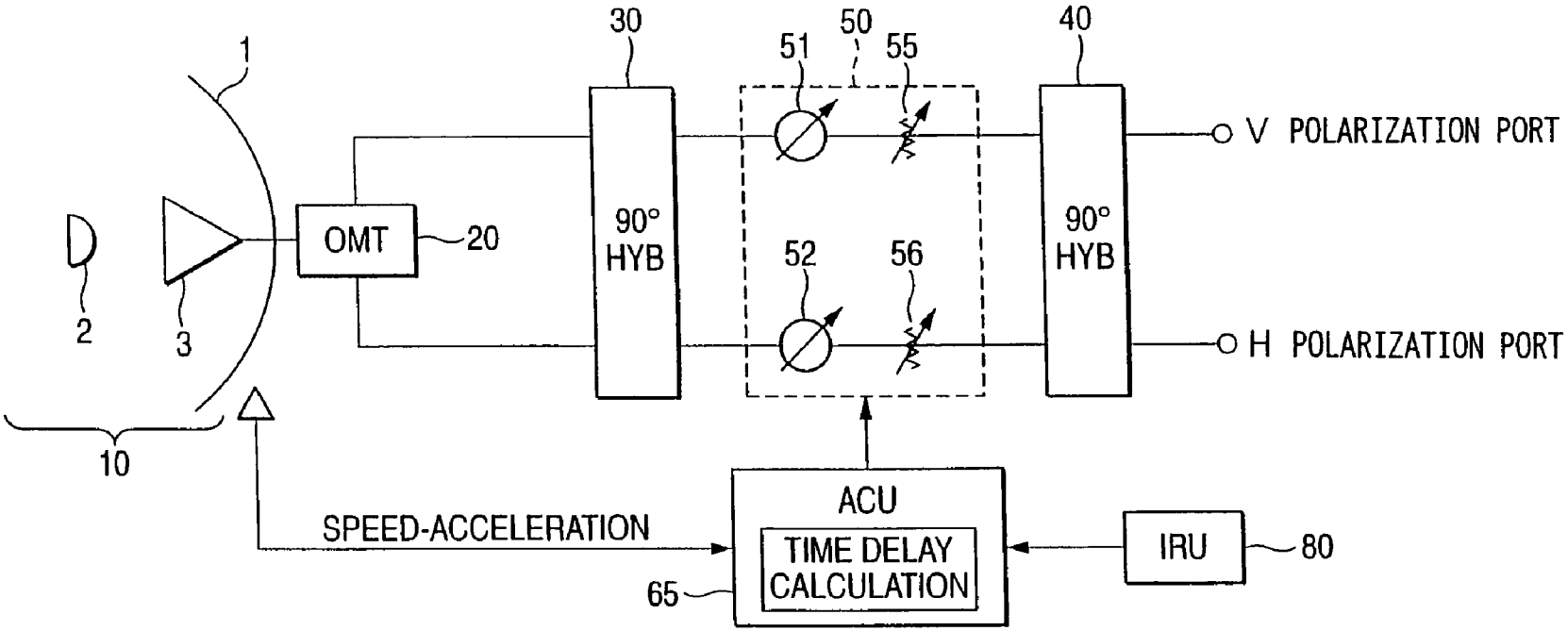
FIG. 6 is a view showing a structure of an antenna apparatus according to embodiment 6.

FIG. 6 is a view showing a structure of an antenna apparatus according to embodiment 6 of the invention.

In the case where an antenna apparatus is mounted on an aircraft, the antenna apparatus always receives the vibration of the aircraft.

Thus, the pointing direction of the antenna is also always changed, and when the pointing direction of the antenna is changed, a polarization plane angle is changed according to its tilt.

Also as described in the embodiment 3, an antenna control unit 65 calculates a necessary polarization plane angle on the basis of data from an IRU 80, and performs the setting and control of variable phase shifters and variable attenuators in a phase-amplitude adjustment block 50. However, at the time point when the phase-amplitude adjustment block 50 is actually controlled, since the antenna angle is changed by the vibration or the like, an error occurs in the polarization plane setting angle.

Then, in the embodiment, as shown in FIG. 6, the antenna control unit 65 captures information of speed and acceleration of the antenna, and sets the polarization plane angle with respect to the pointing direction of the antenna in consideration of a time delay required to acquire the data of the position and tilt of the aircraft from the IRU 80.

By this, the polarization plane angle of the antenna can be set at higher accuracy.

Embodiment 7

Figure 7:
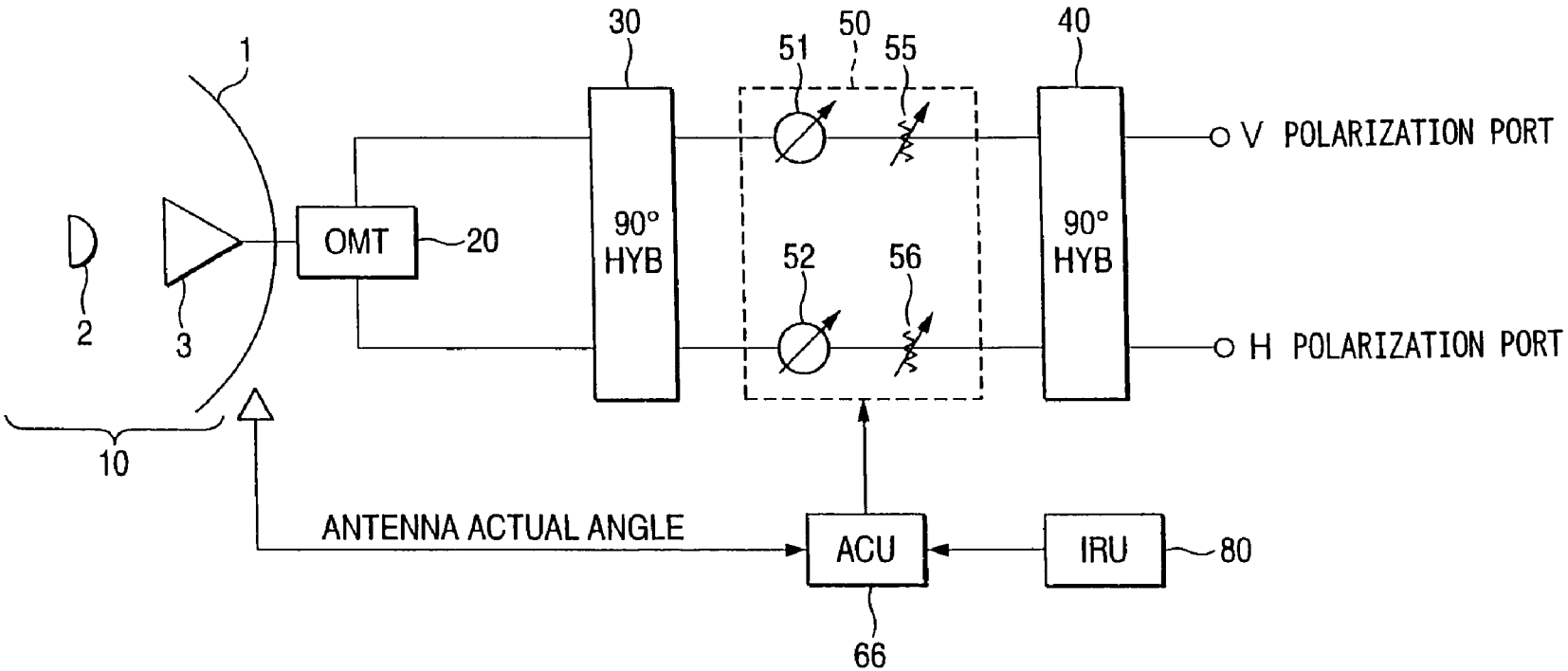
FIG. 7 is a view showing a structure of an antenna apparatus according to embodiment 7.
Figure 8:
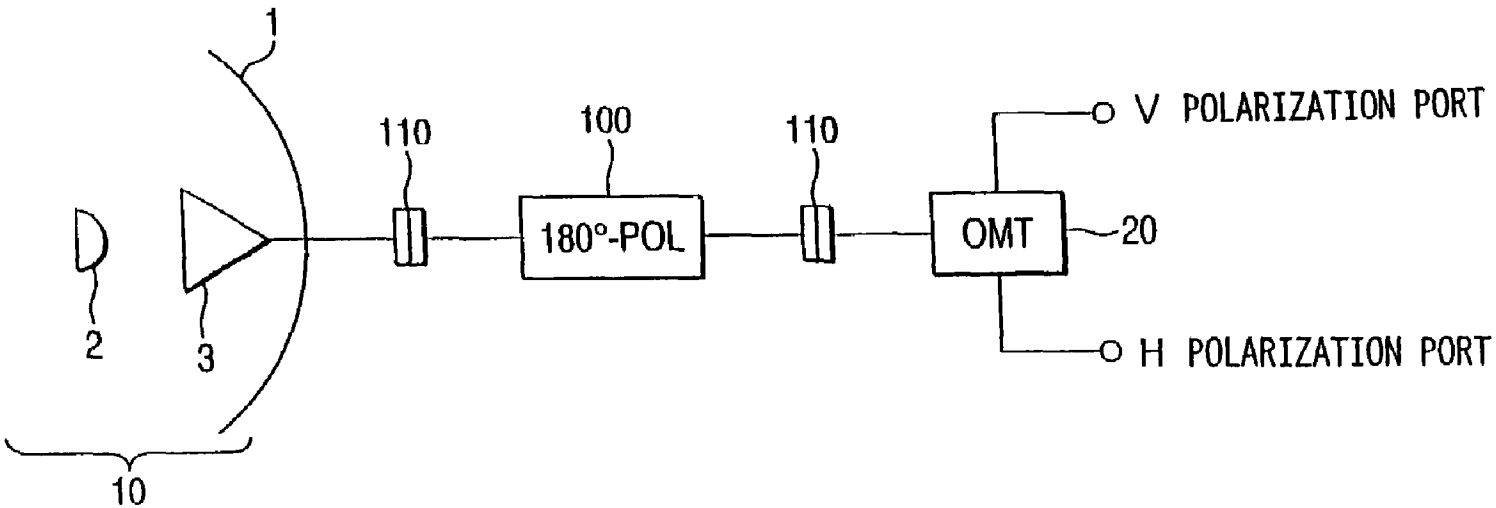
FIG. 8 PRIOR ART
FIG. 8 is a view showing a structure of a conventional antenna apparatus using a 180° polarizer.

FIG. 7 is a view showing a structure of an antenna apparatus according to embodiment 7 of the invention.

The foregoing embodiment 6 is constructed such that the antenna control unit captures the information of the speed and acceleration of the antenna, and the polarization angle with respect to the pointing direction of the antenna is set in consideration of the time delay required to acquire the data of the position and tilt of the aircraft from the IRU 80.

On the other hand, in an antenna control unit 66 according to this embodiment, in order to deal with a time delay required to acquire data of position and tilt of an aircraft from an IRU 80, the pointing direction of an antenna (that is, actual angle of the antenna) is monitored in real time, and the polarization plane setting angle is corrected by an amount of difference between the antenna angle obtained on the basis of the data of the position and tilt of the aircraft from the IRU 80 and the antenna actual angle.

By this, similarly to the case of the embodiment 6, the polarization plane angle of the antenna can be set at higher accuracy.

INDUSTRIAL APPLICABILITY

The invention is useful for realizing an antenna apparatus which uses a reflector antenna to perform transmission/reception of a signal to/from a satellite, is suitable for mounting on an aircraft or the like, is miniaturized and is inexpensive.

The invention claimed is:

1. An antenna apparatus, comprising:

a reflector antenna part which receives a linear polarization signal from a satellite at a time of reception and transmits a linear polarization signal to the satellite at a time of transmission;

an orthomode transducer which divides the linear polarization signal received by the reflector antenna part into two-channel polarized signals orthogonal to each other at the time of reception, and combines two-channel polarized signals orthogonal to each other to convert them into the linear polarization signal at the time of transmission;

a variable power divider which includes a first 90° phase combiner, a second 90° phase combiner, and a phase-amplitude adjustment block provided with variable phase shifters and variable attenuators respectively corresponding to the two-channel polarized signals, adjusts, at the time of reception, phases and amplitudes of the two-channel polarization signals divided by the orthomode transducer and orthogonal to each other and outputs them as a V polarization and an H polarization, and adjusts, at the time of transmission, phases and amplitudes of the inputted two-channel polarized signals of a V polarization and an H polarization and inputs the polarized signals orthogonal to each other to the orthomode transducer;

an antenna control unit which sets phase amounts of the variable phase shifters provided in the phase-amplitude adjustment block and corresponding to the two-channel polarized signals and attenuation amounts of the variable attenuators to desired values; and a phase shifter and an attenuator which are provided on at least one of two-channel signal lines between the orthomode transducer and the first 90° phase combiner, and equalizes amplitudes and phases of the two-channel polarized signals.

2. An antenna apparatus according to claim 1, wherein the antenna control unit includes a correction table storing an amplitude difference and a phase difference occurring on the two-channel signal lines between the orthomode transducer and the first 90° phase combiner, and controls the variable phase shifters and the variable attenuators in the phase-amplitude adjustment block on the basis of the amplitude difference and the phase difference stored in the correction table.

3. An antenna apparatus according to claim 1, wherein the antenna control unit includes a three-axis gyro, and in a period when data of a position and tilt of an aircraft from an IRU is delayed, the antenna control unit uses data of the position and tilt of the aircraft acquired from the three-axis gyro to calculate a necessary polarization plane angle, and performs setting and control of the variable phase shifters and the variable attenuators in the phase-amplitude adjustment block.

4. An antenna apparatus according to claim 1, further comprising a wave detector for detecting the two-channel signals outputted to a Vertical polarization port and an Horizontal polarization port, and wherein the antenna control unit controls a first and a second variable phase shifters and a first and a second variable attenuators in the phase-amplitude adjustment block so that a difference between the two-channel signals outputted to the Vertical polarization port and the Horizontal polarization port becomes maximum, and performs setting and control of a polarization plane angle.

5. An antenna apparatus according to claim 1, further comprising a first and a second DIVs for further dividing the two-channel polarized signals into two channels, respectively, and wherein the phase-amplitude adjustment block includes the first variable phase shifter and the first variable attenuator on one of the signal channels divided by the first DIV, and the second variable phase shifter and the second variable attenuator on one of the signal channels divided by the second DIV, and the antenna control unit sets phase amounts of the respective variable phase shifters of the phase-amplitude adjustment block or attenuation amounts of the respective variable attenuators to desired values.

6. An antenna apparatus according to claim 1, wherein the antenna control unit captures information of speed and acceleration of the antenna, and sets a polarization plane angle in consideration of a time delay required to acquire data of a position and tilt of an aircraft from an IRU.

7. An antenna apparatus according to claim 1, wherein the antenna control unit corrects a polarization plane angle by an amount of difference between an antenna angle obtained on the basis of data of a position and tilt of an aircraft from an IRU and an antenna actual angle.

* * * * *